United States Patent [19]

Courthèoux

[11] 4,341,054

[45] Jul. 27, 1982

[54] APPARATUS FOR FILLING AND HEAT SEALING A BAG

[75] Inventor: Michel P. G. Courthèoux, Chateaurenard, France

[73] Assignee: Etablissements Courtheoux, Bondy, France

[21] Appl. No.: 145,358

[22] Filed: Apr. 30, 1980

[30] Foreign Application Priority Data

Jun. 13, 1979 [FR] France ..... 79 15167

[51] Int. Cl.[3] ..... B65B 3/16

[52] U.S. Cl. ..... 53/268; 53/266 R; 53/373; 53/469

[58] Field of Search ..... 53/552, 551, 379, 378, 53/479, 480, 373, 371, 451, 469, 175, 268, 273, 266 R

[56] References Cited

U.S. PATENT DOCUMENTS

| | | | |
|---|---|---|---|
| 3,220,161 | 11/1965 | Lohse | 53/373 |
| 3,241,290 | 3/1966 | Ingleson | 53/371 |
| 3,306,001 | 2/1967 | Peppler | 53/451 X |
| 3,469,364 | 9/1969 | Bischoff | 53/469 |
| 3,630,665 | 12/1971 | Andersen et al. | 53/469 X |
| 3,750,721 | 8/1973 | Hudson | 53/386 X |
| 3,774,509 | 11/1973 | Heinzer | 53/175 X |
| 3,802,153 | 4/1974 | Dominici | 53/552 X |
| 3,855,907 | 12/1974 | Johnson et al. | 53/469 X |
| 3,889,449 | 6/1975 | Membrino | 53/373 X |

FOREIGN PATENT DOCUMENTS 2503403 7/1976 Fed. Rep. of Germany .

*Primary Examiner*—James F. Coan

*Attorney, Agent, or Firm*—Sixbey, Friedman & Leedom

[57] ABSTRACT

A process and apparatus are described for closing, by means of a line of heat-welding, the opening in a flexible plastic bag filled with a product; a slack is provided in the part of the bag below the line of heat-welding immediately before the heat-welding is carried out.

2 Claims, 11 Drawing Figures

APPARATUS FOR FILLING AND HEAT SEALING A BAG

Figure 1:
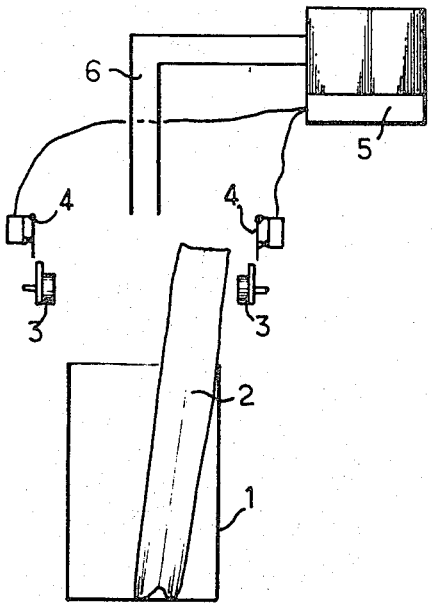

The present invention relates to the manufacture by machine of closed bags, cushions and milk containers, made of a flexible plastic material and containing a product, more particularly a liquid product. It relates more particularly to the manufacture of relatively heavy packaged products of this kind.

The various known processes for machine-manufacturing polyethylene bags cannot be used if the weight of the product exceeds one kilogram. In order to obtain a package for a heavy liquid product, a bag made of a flexible plastic material was filled and the opening closed with a line of heat-welding. Carrying out this operation with a machine raises a number of problems, the most serious of which are improper sealing of the line of heat-welding and numerous failures in the feed.

The present invention overcomes these problems.

The process according to the invention involves providing some slack in the part of the bag below the line of heat-welding, immediately before the heat-welding operation.

In this way, the pull produced by the weight of the product is absorbed by the part of the bag which is not under tension, below the welding zone, instead of by the zone itself. Experience has shown that this eliminates sealing defects.

The invention is also concerned with an apparatus for carrying out the process, the apparatus comprising means for maintaining the top of the bag at a constant level and means for lifting the bottom of the bag.

The bag is filled by opening it with suckers applied to the outer lateral surfaces, and inserting a liquid-supply line into the opening thus produced. The suckers are then placed in contact with the supply-line, with the bag therebetween, whereupon the liquid is poured through the line into the bag.

This prevents the bag from crumpling up, as it is being filled, into the bottom of the basket which supports it, as a result of the weight of the liquid.

The apparatus used to filled the bag comprises suckers which are applied to the outer lateral surfaces of the bag, and electrical contacts which are actuated by these surfaces when the suckers come into action, thus closing an electrical circuit controlling the supply-line which feeds the liquid into the bag.

This ensures that there is no feed until the bag is properly open. Other arrangements which do not use direct contact with the bag, and sensors, have not been found reliable.

Attached hereto, solely by way of example, are drawings wherein:

FIGS. 1 to 6 are side elevations illustrating six stages in the process of filling a bag, while FIGS. 7 to 11 are front elevations illustrating five stages in the process of closing a bag.

A prismatic basket 1, carrying a polyethylene bag 2 designed to accommodate 2500 g of a liquid syrup, moves to the first station of a turntable, not shown, the basket being supported by means not shown.

Two pairs of suckers 3 are arranged on each side of the bag asymmetrically, in such a manner that no two suckers are face to face. Mounted on each side of the bag, and at a distance therefrom when the edges of the opening are close together, are two pairs of electrical contacts 4 in the form of thin rods. The contacts are connected to a time-delay device 5 controlling the supply from a line 6 mounted in such a manner that it can be moved from a position above the opening in the bag to a position in which it is inserted thereinto.

Figure 2:
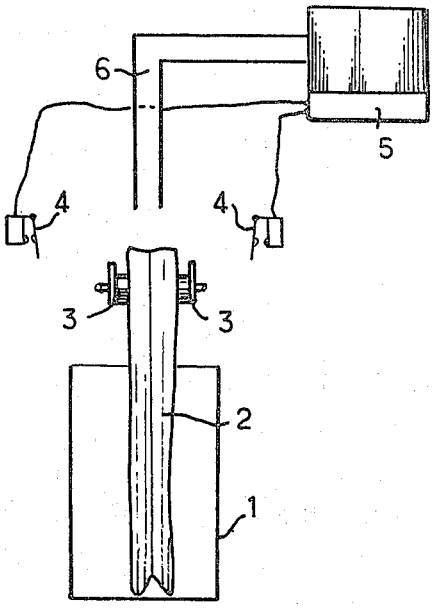
Figure 3:
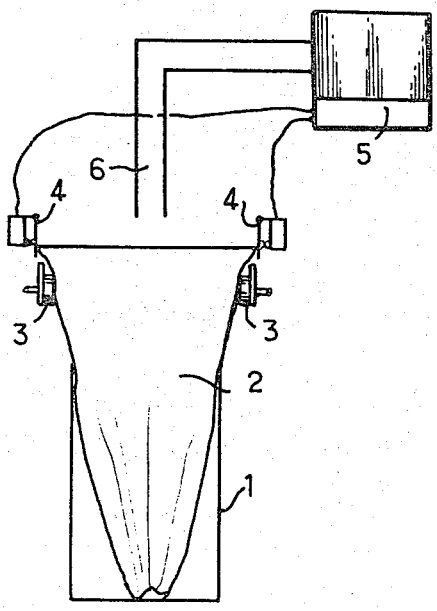
Figure 4:
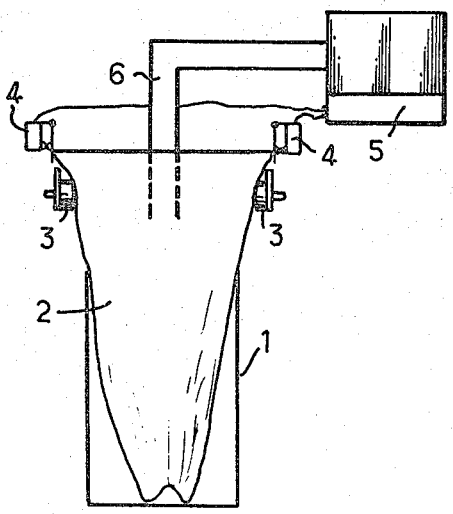
Figure 5:
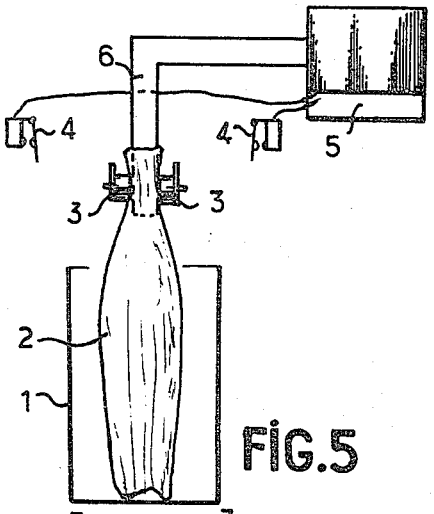
Figure 6:
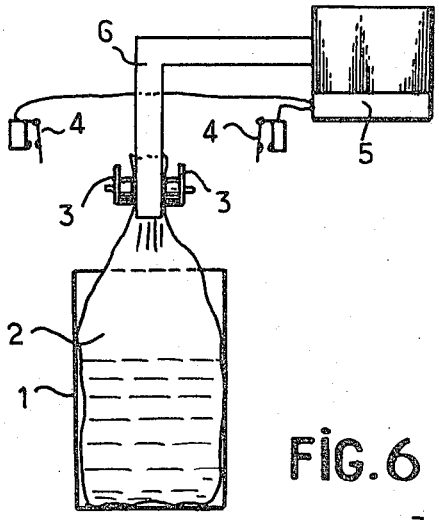

In FIG. 1, bag 2 has just reached the station. In FIG. 2, suckers 3 have moved towards each other and are applied to the outer lateral surfaces of the bag. In FIG. 3, the suckers move apart, carrying with them the surfaces of the bag. The bag opens. The lateral faces of the bag push contacts 4 away.

This closes the electrical circuit to control device 5, initially causing line 6 to descend into the bag (FIG. 4), then causing the suckers to contact line 6, with the surfaces of the bag in between, thus holding the bag, and then causing the opening of the supply valve in line 6. After some of the prescribed quantity of liquid has entered, the suckers release the bag to allow it to be weighed.

Bag 2 is closed by heat-welding at the next station on the turntable.

Figure 7:
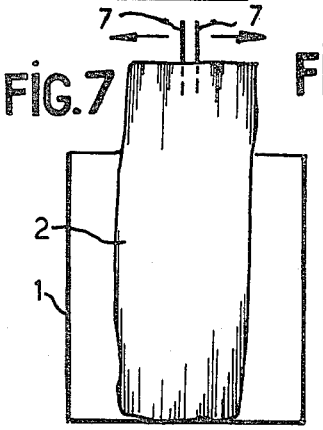
Figure 8:
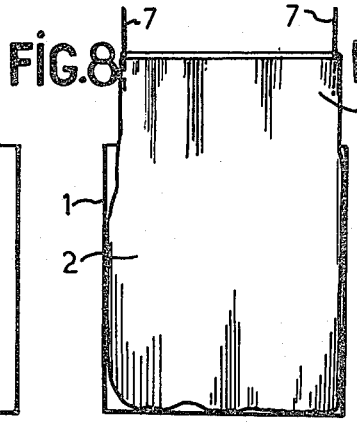
Figure 9:
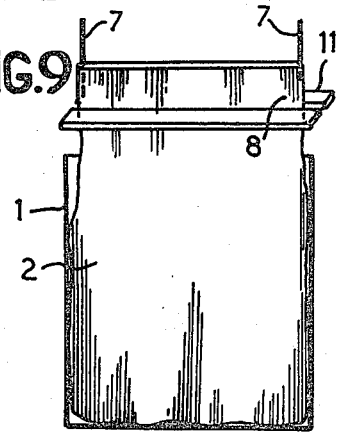

Two fingers 7 engage at the centre of the opening into the bag (FIG. 7). At this time, the bag full of liquid is still wide open. The fingers do not miss the opening and enter the interior of the bag safely;

By means of a jack mechanism, not shown, thin fingers 7 are drawn away (FIG. 8) in the direction of the arrows in FIG. 7, assuming positions in the opening of the bag as far as possible from each other. As a result of this, the lateral surfaces of an upper part 8 of the bag, adjacent the lower ends of the fingers, are brought together by the tension produced by the fingers. This tension is horizontal and maintains the top of the bag at a constant level. Heat-welding jaws 11 are now closed, but without effecting any welding, thus holding part 8 mechanically (FIG. 9) and preventing any creasing thereof.

Figure 10:
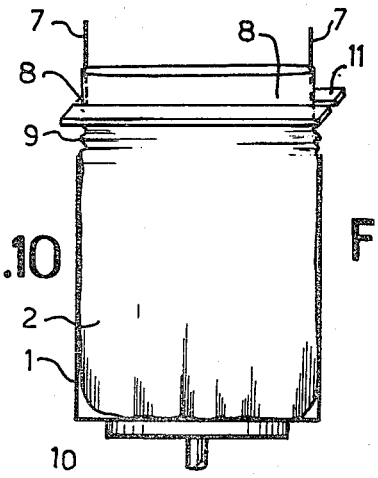
Figure 11:
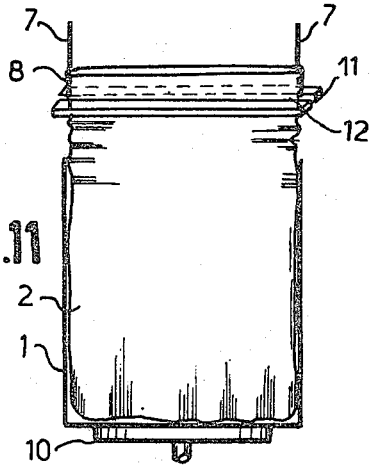

In FIG. 10, the bottom of basket 1, containing bag 2, has been lifted by a jack 10, in order to provide some slack in part 9 of the bag adjacent part 8. In FIG. 11, the surfaces of the bag are welded together, along a line 12 running in part 8, by means of heat-welding jaws 11. Thanks to the slack provided in part 9, any pull due to the weight of the liquid in the bag is absorbed by elongation of part 9. This leaves intact part 8 where the heat-welding takes place, and which must be protected against any traction if the weld is to provide a proper seal.

References known by the Applicant are German Pat. No. 2,503,403 (Sieburg) and U.S. Pat. Nos. 3,220,161 (Lohse), 3,241,290 (Ingleson) and 3,889,449 (Membrino).

What I claim is:

1. An apparatus for manufacturing a closed flexible plastic bag filled with a liquid product and having a bottom, a top with an opening and two edges, comprising a basket into which said bag is placed; means for closing the top of the bag by heat welding; means for holding the top of the bag at a constant level, said holding means including edge moving means for bringing the two edges of the opening in contact with each other, said edge moving means comprising two vertical fingers engaged at the centre of the opening and moved away from each other by a mechanism to opposite zones in said opening as far as possible from each other; means for raising the basket for raising the bottom of the bag; means for filling the bag with a liquid product through the opening; and means for operating simultaneously the means for raising the basket for raising the bottom of the filled bag and the means for holding the top of the filled bag at a constant level.

2. An apparatus for manufacturing a closed flexible plastic bag filled with a liquid product and having a bottom, a top with an opening and two edges, comprising means for closing the top of the bag by heat welding; means for holding the top of the bag at a constant level; means for raising the bottom of the bag; means for filling the bag with a liquid product through the opening, said filling means including supply line means communicating with said bag through the opening; means for operating simultaneously the means for raising the bottom of the filled bag and the means for holding the top of the filled bag at a constant level; an electrical circuit for controlling liquid flow through the supply line means; suckers arranged asymmetrically with respect to and applied to the outer surfaces of the bag; and, electrical contacts pushed away by the surfaces when the suckers come into action, whereby the electrical circuit is closed which controls the opening of the supply line means for supplying liquid flow to the bag.

* * * * *